United States Patent [19]

Ito et al.

[11] Patent Number: 4,611,872

[45] Date of Patent: Sep. 16, 1986

[54] WATER-PROOF CONNECTOR

[75] Inventors: Katsuya Ito, Yokkaichi; Shinichi Yamada, Kanazawa, both of Japan

[73] Assignee: Tokai Electric Wire Company Limited, Japan

[21] Appl. No.: 643,641

[22] Filed: Aug. 23, 1984

[30] Foreign Application Priority Data

Sep. 21, 1983 [JP] Japan ..... 58-147120[U]
Sep. 21, 1983 [JP] Japan ..... 58-147121[U]

[51] Int. Cl.[4] ..... H01R 4/00
[52] U.S. Cl. ..... 339/94 M; 339/60 R
[58] Field of Search ..... 339/94, 59–63, 339/126 RS

[56] References Cited

U.S. PATENT DOCUMENTS

| | | | |
|---|---|---|---|
| 3,493,670 | 2/1970 | Broadbelt et al. | 339/94 M |
| 3,818,420 | 6/1974 | Barr | 339/94 R |
| 3,937,545 | 2/1976 | Cairns et al. | 339/94 |
| 3,986,765 | 10/1976 | Shaffer et al. | 339/126 RS |
| 4,114,974 | 9/1978 | Lawrence | 339/94 C |
| 4,173,349 | 11/1979 | Neale, III | 339/94 C |
| 4,193,655 | 3/1980 | Herrmann, Jr. | 339/94 M |
| 4,312,553 | 1/1982 | Lyckesjo | 339/94 M |
| 4,395,085 | 7/1983 | Inoue | 339/94 |
| 4,443,048 | 4/1984 | Moist | 339/63 M |

FOREIGN PATENT DOCUMENTS

| | | | |
|---|---|---|---|
| 1314138 | 11/1962 | France | 339/94 M |

*Primary Examiner*—Gil Weidenfeld
*Assistant Examiner*—David L. Pirlot
*Attorney, Agent, or Firm*—Ernest A. Beutler

[57] ABSTRACT

A water-proof connector having a seal ring in the connection between a male connector housing with a male connector and a female connector housing with a female connector is disclosed. Engaging mechanism and protecting members holds the seal ring on the male connector housing. The insertion or separation of the male connector housing and the female connector housing is facilitated and the water-proof effect is improved.

9 Claims, 20 Drawing Figures

WATER-PROOF CONNECTOR

BACKGROUND OF THE INVENTION

The present invention relates to a water-proof connector or more in particular to a water-proof connector using a water-proof seal ring in the coupling of a female connector housing and a male connector housing, or especially an engaging construction of a water-proof seal ring ("O" ring).

Four types of construction of water-proof seal ring engaging constructions shown in FIGS. 1A to 1D are well known for conventional water-proof connectors. In FIG. 1A, a seal ring 3 is fitted on the misalignment 1*b* formed at the forward end 1*a* of a female connector housing 1, a holder 4 for preventing separation of the seal ring 3 is mounted at the forward end 1*a* of the female connector housing, and the female connector housing 1 is coupled with a male connector housing 2. Reference numeral 7 designates a male connector. A female connector is not shown in the drawing.

In FIG. 1B, on the other hand, an annular slot for the seal ring 3 is formed near the forward end 1*a* of a female connector housing 1, and the seal ring 3 is fitted in the annular slot 5.

The construction of the water-proof connector shown in FIG. 1C is such that a seal ring 3 is fitted in a recess 6 at the last half portion 2*b* of a male connector housing 2, the first half portion 2*a* of the male connector housing 2 doubling as a member for preventing separation of the seal ring 3 is brought into contact with the seal ring 3, and the outer peripheries of the first and second half portions are welded to each other thereby to fixedly engage the seal ring 3.

The water-proof connector of FIG. 1D is so constructed that an annular engaging protrusion 8 is formed in the recess 6 of the male housing 2, and a seal ring 3 is fixedly fitted between the bottom and the engaging protrusion 8 of the recess 6.

The above-described conventional engaging constructions have the disadvantages mentioned below respectively.

The construction of FIG. 1A requires a considerable number of parts, the others resulting in a high cost and involves more steps due to the requirement of the holder to be fixed by welding or like means. In the construction of FIG. 1B, the annular slot 5 is required to be molded integrally with the female housing 1 by use of a couple of vertically-split dies, which unavoidably causes a burr along the part line separating the upper and lower dies, thus deteriorating the sealing performance. The water-proof connector of FIG. 1C is bulkier than those of FIGS. 1A or 1B, and also, because of the requirement of welding equipment such as ultrasonic welder, is impractically high in cost. Lastly, in the construction of FIG. 1D, the height of the engaging protrusion 8 is limited to 0.3 to 0.5 mm for processing reasons, so that the seal ring 3 is liable to come off during transportation on the one hand and upon mounting or demounting of the female connector housing 1, the seal ring 3 is sometimes reversed and peeled or separated off by the fitting or separation resistance respectively. Further, the seal rings 3 of the constructions of FIGS. 1A and 1B are fitted exposed on the outer periphery, and therefore is often damaged in contact with other members. In the constructions of FIGS. 1C and 1D, by contrast, in spite of the advantage of the seal ring 3 being built in and protected from damage, the seal ring 3 cannot be visually identified from outside.

SUMMARY OF THE INVENTION

Accordingly, it is an object of the present invention to provide a water-proof connector which comprises a fewer number of parts and has a high sealing effect to obviate the shortcomings of the conventional water-proof connector constructions and to provide a water-proof connector in which the connector housings are mutually easily fitted or separated while holding the water-proof seal ring effectively in position.

Another object of the present invention is to provide a water-proof connector in which any damage of the water-proof seal ring can be revented and the seal ring can be easily identified.

A further object of the invention is to provide a water-proof connector in which the water-proof seal ring is protected from external contact and is not subject to an external force.

BRIEF DESCRIPTION OF THE DRAWINGS

The present invention will be apparent from the following detailed description taken in conjunction with the accompanying drawings, in which.

DESCRIPTION OF THE PREFERRED EMBODIMENT

Figure 1A:
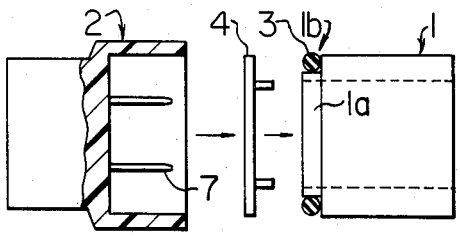
FIG. 1A PRIOR ART
FIGS. 1A to 1D are sectional views of conventional water-proof connector constructions.
Figure 1B:
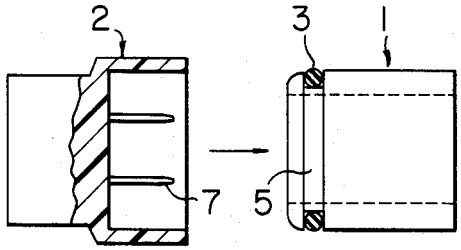
FIG. 1B PRIOR ART
Figure 1C:
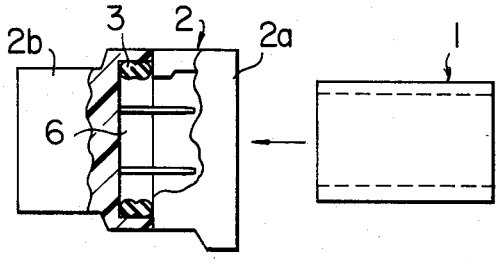
FIG. 1C PRIOR ART
Figure 1D:
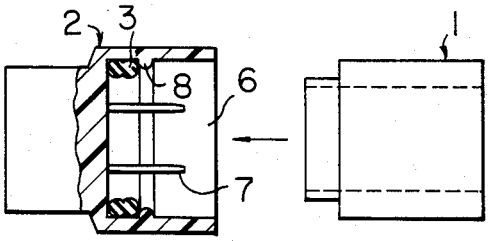
FIG. 1D PRIOR ART
Figure 2:
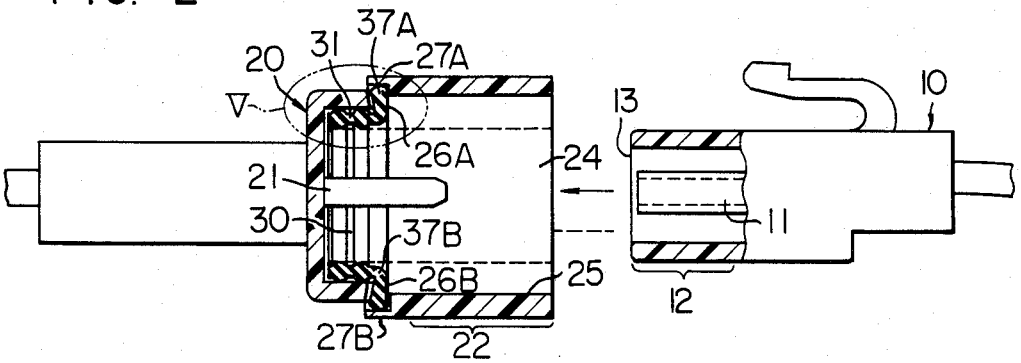
FIG. 2 is a sectional view of a water-proof connector according to a first embodiment of the present invention.

Embodiments of the present invention will be described with reference to the drawings. FIG. 2 is a diagram generally showing a water-proof connector according to a first embodiment of the present invention. Reference numeral 10 designates a female connector housing, numeral 11 a female connector, numeral 20 a male connector housing, and numeral 21 a male connector. Numeral 30 designates a water-proof seal ring. In this drawing, the water-proof seal ring 30 is mounted on the male connector housing 20, while the female connector housing 10 is not mounted thereon.

The various parts of the connector will be explained. Numeral 12 designates the first half portion of the female connector housing 10, and numeral 13 the forward end thereof. Numeral 22 designates the first half portion of the male connector housing, and numeral 23 the rear end thereof. In similar fashion, numeral 24 is defined as a recess of the male connector housing, numeral 25 as a peripheral wall, numeral 26A, 26B as seal ring stopper slots, numeral 27A, 27B as cover plates thereof. Numeral 31 designates a cylindrical body of the seal ring, and numeral 32 an engaging portion.

Figure 3A:
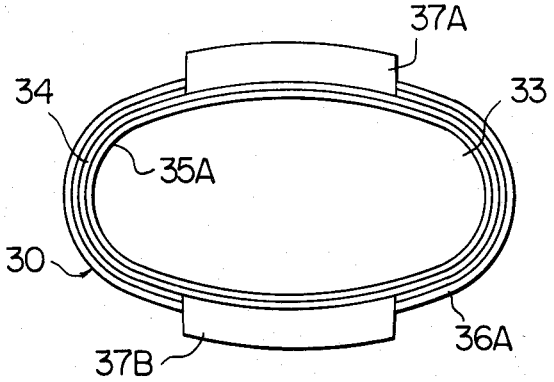
FIG. 3A is a front view of a seal ring used in the above embodiment.
Figure 3B:
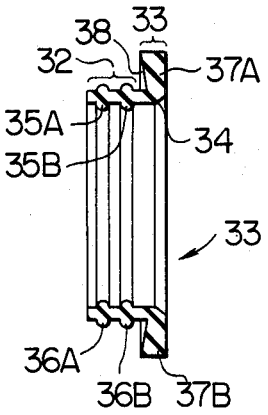
FIG. 3B a plan view.
Figure 3C:
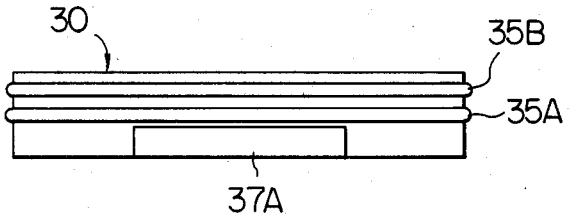
FIG. 3C a side view of the same seal ring.

FIGS. 3A to 3C show details of the seal ring 30. The seal ring 30 includes a cylindrical portion 31 formed on a tubular rubber ring with a through hole 33 to be fitted on the body of the female connector housing 10, and an engaging portion 32. The internal rear end of the engaging portion 32 is formed with a cup-shaped taper 34 for guiding the female connector housing 10 as the latter is inserted. The inner surface of the cylindrical member 32 is provided with annular protrusions 35A, 35B adapted to be pressed hermetically against the body of the female connector housing 10. In similar manner, the exterior surface of the cylindrical portion 32 is formed with annular protrusions 36A, 36B adapted to be hermetically sealed against the peripheral wall 25 of the recess 24 of the male connector housing 20.

A pair of engaging protrusions 37A, 37B are formed over a certain length along the outer periphery of the engaging portion 33 of the seal ring 30. The engaging protrusions 37A, 37B are engaged with the seal ring stopper slots 26A, 26B of the male connector housing 20, and are provided for the purpose of holding the seal ring 30 in position.

Figure 4A:
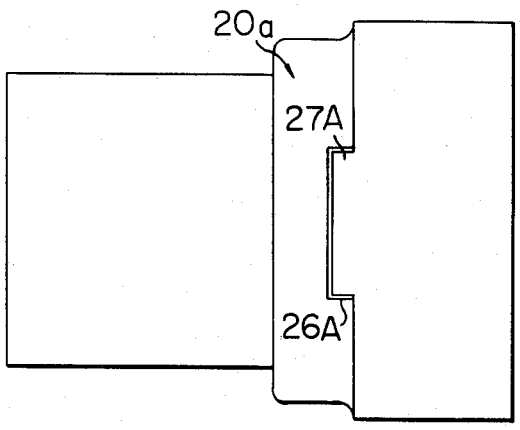
FIG. 4A is a front view of a male connector housing according to a first embodiment of the present invention, FIG. 4B a plan view and FIG. 4C a side view of the same male connector housing.
Figure 4B:
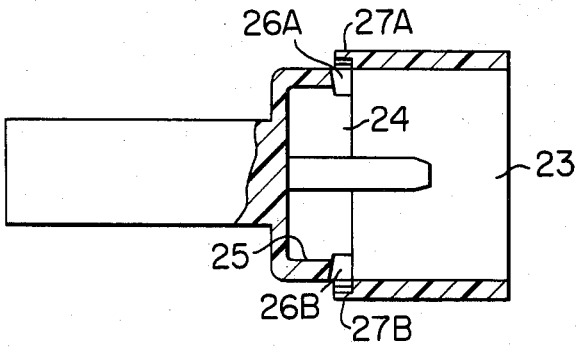
Figure 4C:
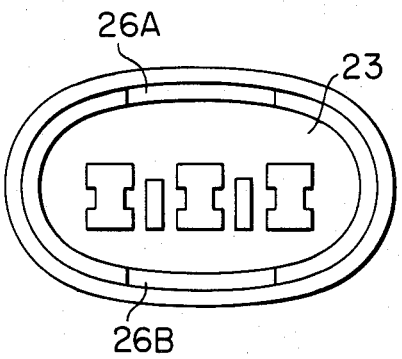

FIGS. 4A to 4C illustrate a male connector housing 20 of the first embodiment in detail. In order to receive a first half portion 12 of a female connector housing 10, seal ring stopper slots 26A, 26B adapted to fit with the engaging protrusions 37A, 37B of the seal ring 30 are formed on the peripheral wall 25 of the recess 23 of the rear end portion 24 of the male connector housing 20. On the outside of the seal ring stopper slots 26A, 26B, cover plates 27A, 27B are arranged extending from the rims of the seal ring stopper slots 26A, 26B like a cantilever. The cover plates 27A, 27B cover the upper rims of the engaging protrusions 37A, 37B fitted in the seal ring stopper slots 26A, 26B on the one hand, and a small gap is formed between the forward end of the cantilever of the cover plates 27A, 27B and the other rim of the seal ring stopper slots 26A, 26B on the other hand. The male connector housing 20 including the cover plates 26A, 26B may be formed integrally.

Figure 5:
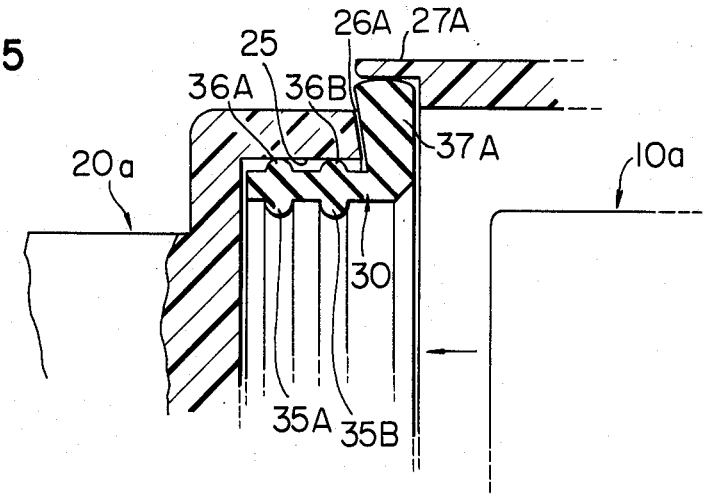
FIG. 5 is a diagram showing, partially enlarged, the coupling of the male connector housing and a seal ring according to the first embodiment.

With reference to FIGS. 2 and 5, explanation will be made of the functions of the engaging mechanism including the engaging protrusions 37A, 37B of the seal ring 30 and the seal ring stopper slots 26A, 26B of the male connector housing 20 explained with reference to the third embodiment above.

The seal ring 30 is inserted fixedly in the recess 24 of the male connector housing 20 in advance, and the engaging protrusions 37A, 37B are fitted in the seal ring stopper slots 26A, 26B thereby to bring the seal ring 30 into engagement with the recess 23. In the process, the upper rims of the engaging portions 37A, 37B of the seal ring 30 come into contact with the cover plates 27A, 27B, while a small gap is formed with the side rim of the seal ring 30.

By inserting the female housing connector 10 into the male housing connector 20, the female connector 11 and the male connector 21 are coupled to each other. By way of the annular protrusions 35A, 35B, 36A, 36B formed on the seal ring 30, on the other hand, the male connector housing 20 and the female connector housing **10*a* are pressed against each other through the seal ring 30** to secure the sealing performance.

In the water-proof connector according to the first embodiment provided with the engaging mechanism of the above-mentioned construction, the inserted seal ring 30 settles very stable in position. It is difficult for the seal ring 30 to come off or the cylindrical portion 32 of the seal ring 30 to reverse out of position, thereby stabilizing the sealing functions. Further, the cover plates 27A, 27B covering the engaging protrusions 37A, 37B of the seal ring 30 provided over the seal ring stopper slots 26A, 26B prevent the seal ring 30 from coming off when the engaging protrusions 37A, 37B are in contact with other members or with other external forces as by hand, thus further improving the stability of the seal ring 30.

Figure 6:
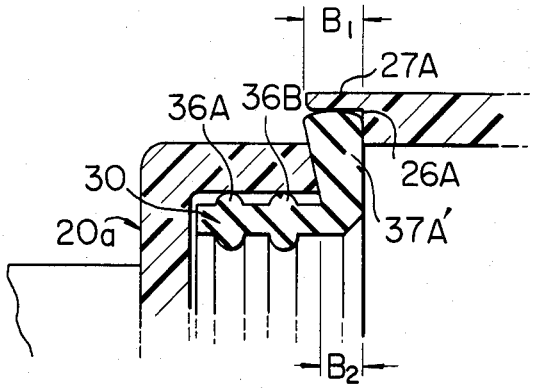
FIG. 6 is a diagram showing, partially enlarged, the coupling of a male connector housing and a seal ring according to a second embodiment of the present invention.
Figure 7:
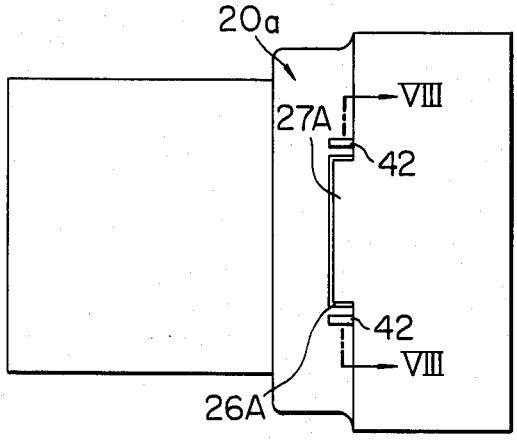
FIG. 7 is a front view of a male connector housing according to a second embodiment of the present invention.
Figure 8:
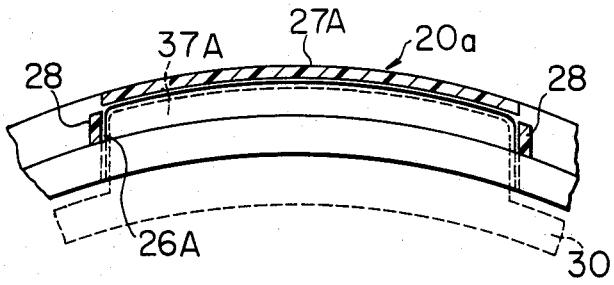
FIG. 8 is a diagram showing a partial sectional view of a male connector housing according to a second embodiment.

With reference to FIGS. 6 to 8, a second embodiment of the prèsent invention will be explained. The water-proof connector comprising a seal ring 30, engaging ptotrusions 37A, 37B, and seal ring stopper slots 26A, 26B of the male connector housing **20*a* and cover plates 27A, 27B identical to those of the third embodiment, has the maximum width $B_1$ of the head of the engaging protrusions 37A', 37B' slightly larger than the width $B_2$ of the seal ring stopper slots 26A, 26B, the engaging protrusions 37A' and 37B' of the seal ring 30 being press-fitted into the seal ring stopper slots 26A, 26B. The structure of the engaging protrusions 37A', 37B' press-fitted into the seal ring stopper slots 26A, 26B further improves the engaging force of the seal ring 30** as compared with the first embodiment.

A second embodiment will be explained with reference to FIG. 8. According to this embodiment, protective plates 28 are erected along the longitudinal rims of the seal ring stopper slots 27A, 27B formed in the male connector housing **20*a* of the third embodiment. FIG. 8 shows a partial sectional view taken in the line VIII—VIII in FIG. 7. The engaging protrusions 37A, 37B of the seal ring 30 are contained in the cover plates 27A, 27B and the protective plates 28 and thus the seal ring is completely prevented from being separated under an external force to which the engaging protrusions 37A, 37B** may be subjected.

In the above-described first and second embodiments, the cover plate 27A, 27B may not necessarily be a single plate covering the upper part of the seal ring stopper slots 26A, 26B but may take a form of a plurality of laterally aligned plates with notches at predetermined positions thereby to facilitate the identification of the seal ring 30.

Figure 9A:
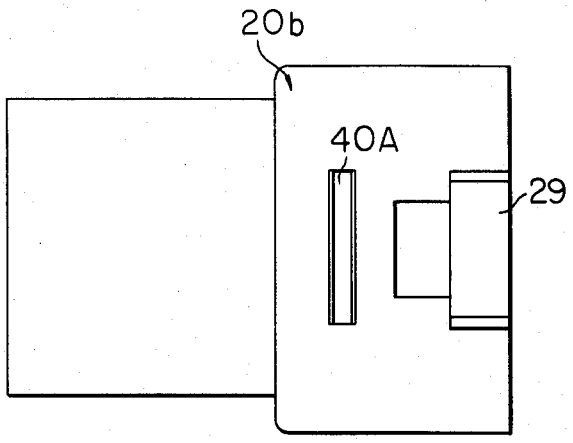
FIG. 9A is a front view of a male connector housing according to a third embodiment of the present invention, FIG. 9B a top sectional view and FIG. 9C side sectional view respectively of the same male connector housing.
Figure 9B:
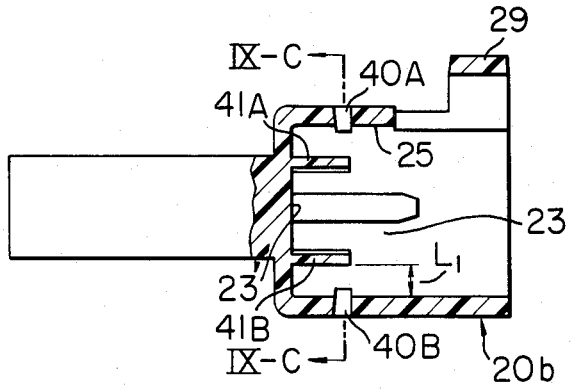
Figure 9C:
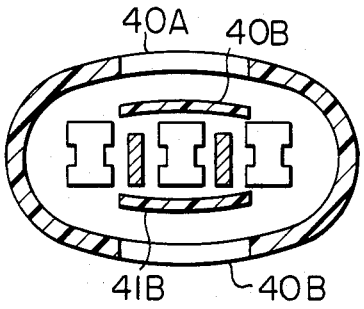

A third embodiment of the present invention will be explained with reference to FIGS. 3A to 3C and FIGS. 9A to 9C. The construction of the seal ring 30 is the same as that of the first or second embodiment. FIGS. 9A to 9C show a male connector housing **20*b*, FIG. 10 a sectional view of the water-proof connector of the embodiment under consideration, and FIG. 11 a part detail of the construction shown in FIG. 10. First, the male connector housing 20*b*** will be explained.

In order to receive the first half portion of the female connector housing **10*b*, the male connector housing 20*b* is provided with seal ring stopper slots 26A, 26B to be fitted with the engaging protrusions 37A, 37B of the seal ring 30 on the peripheral wall 25 of the recess 23 of the male connector housing 20*b*. Further, thin tongues 41A, 41B are integrally formed with the base 23' of the recess 23 with a small gap with the peripheral wall 25 inward of the seal ring stopper slots 40A, 40B within the recess 23. The forward ends of the thin tongues 41A, 41B extend to a point near the seal ring stopper slots 40A, 40B and thus face the entrance of the recess 23. Specifically, the thin tongues 41A, 41B are for preventing the seal ring 30 from separation or peeling off as it is inserted into the recess 23. The gap $L_1$ between the thin tongues 41A, 41B and the inner surface of the recess 23 is smaller than the distance $L_2$ from the base of the engaging protrusions 37A, 37B to the forward end of the seal ring 30 as shown in FIG. 11. The thin tongues 41A, 41B are adapted to fit the grooves 12A, 12B formed in the head of the female connector housing 10*b* when the female connector housing 10*b* is inserted into the recess 23. The thin tongue 41A, 41B is not necessarily a single plate respectively, but may take a form of a protruded plate divided to have longitudinal slits or notches. Also, the forward end of the thin tongues 41A, 41B may not be extended under the seal ring stopper slots 40A, 40B. Numeral 29 in FIG. 10** designates engaging portions of the female and male connector housings in coupled state.

The engaging mechanism of the water-proof connector according to the third embodiment including the engaging protrusions 37A, 37B of the seal ring 30, the seal ring stopper slots 40A, 40B of the male connector housing **20*b* and the thin tongues 41A, 41B, secures the seal ring 30** stably in position while at the same time improving the sealing functions thereof.

Further, in view of the fact that the thin tongues 41A, 41B are provided through the clearance $L_1$ on the inside of the seal ring stopper slots 40A, 40B, the engaging protrusions 37A, 37B of the seal ring 30 are prevented from projecting from the seal ring stopper slots 40A, 40B. Furthermore, the engaging protrusion 37A, 37B are protected from contact with other members or from an external force. What is more, even if the seal ring 30 is tilted in the recess 23 of the male connector housing **20*b* as shown by dotted line of FIG. 11, the resulting contact of the forward end of the seal ring 30 with the thin tongues 41A, 41B prevents the seal ring 30 or the engaging protrusions 37A, 37B from being separated. In addition, the tendency of reversal or separation of the seal ring by the contact resistance between the female connector housing 10*b* and the annular protrusions 35A, 35B upon mounting or demounting of the female connector housing 10*b* is dampened by the thin tongues 41A, 41B. It is therefore unnecessary to increase the hardness of the seal ring 30 or increase the engaging force to unnecessary degree by forcible insertion of the engaging protrusions 37A, 37B into the seal ring stopper slots 40A, 40B. As a consequence, the seal ring 30 is formed in proper shape and hardness facilitating the mounting of the seal ring 30** to secure table sealing effect thereof.

Figure 10:
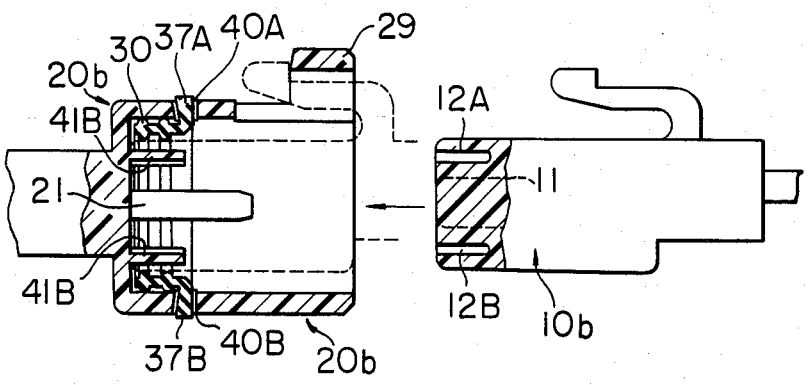
FIG. 10 is a sectional view of a water-proof connector according to the third embodiment.
Figure 11:
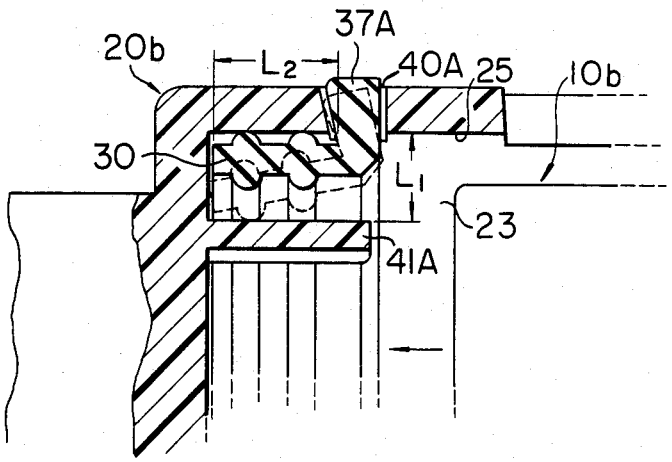
FIG. 11 is a diagram showing, partially enlarged, the coupling of the male connector housing and a seal ring according to the third embodiment.

The thin tongues 41A, 41B have also the function to guide the female connector housing **10*b* as it is inserted as shown in FIG. 10, and therefore prevent the female connector housing 10*b*** from tilting as it is inserted or from being inserted reversely.

Although a seal ring 30 of rubber is used for explanation of the above-mentioned embodiments, any other material which is subject to deformation under pressure may alternatively be used with equal effect.

According to the invention, there are desirably arranged a couple of engaging protrusions 37A, 37B symmetrically with each other for stabilization of the seal ring. Depending on the circumstances, however, three or more engaging protrusions may be used.

We claim:

1. A water-proof connector comprising a seal ring in a coupling between a first connector housing with a first connector and a second connector housing with a second connector, wherein said seal ring includes a cylindrical portion and an engaging portion, said cylindrical portion including annular protrusions, said engaging portion including at least two engaging protrusions, seal ring stopper slots extending through said first connector housing for engaging the engaging protrusions of said seal ring, said engaging protrusions of said seal ring being retained within said seal ring stopper slots of said first connector housing while said first connector housing is inserted into said second connector housing with said annular protrusions of said seal ring being compressed between said connector housings when assembled for water-proofing purpose, said first connector housing having protecting members overlying at least in part said seal ring stopper slots and sealingly engaged by said seal ring engaging protrusions when said connector housings are assembled for further improving water-proofing sealing.

2. A water-proof connector according to claim 1, wherein said protecting members form cover plates for covering the outer periphery of said engaging protrusions of said seal ring.

3. A water-proof connector according to claim 1, wherein the protecting members comprise protective plates formed on said second connector housing.

4. A water-proof connector according to claim 1, wherein the width of said seal ring stopper slots is larger than the width of said engaging portion of said seal ring in the direction of assembly of the connector housing.

5. A water-proof connector according to claim 1, wherein said seal ring is formed of a material subject to deformation under pressure.

6. A water-proof connector according to claim 5, wherein said seal ring is formed of rubber.

7. A water-proof connector as set forth in claim 1, wherein the first connector housing is formed with a cavity and the second connector housing if formed with a projection adapted to extend into he cavity, the seal ring being adapted to be positioned between the projection and the cavity for sealingly engaging the first and second connector housings.

8. A water-proof connector as set forth in claim 7, wherein the protecting members are spaced outwardly from the seal ring stopper slots so as to permit viewing of the seal ring when assembled.

9. A water-proof connector comprising a seal ring in a coupling between a first connector housing defining a cavity receiving a first connector and a second connector housing having a projection extending into said first connector housing cavity and containing a second connector, wherein said seal ring includes a cylindrical portion extending between said cavity of said first connector housing and said projection of said second connector housing and an engaging portion, said cylindrical portion including annular protrusions, said engaging portion including at least two engaging protrusions, seal ring stopper slots extending through said first connector housing receiving the engaging protrusions of said seal ring, said engaging protrusions of said seal ring being retained within said seal ring stopper slots of said first connector housing while said first connector housing is inserted into said second connector housing with said annular protrusions of said seal ring being compressed between said connector housings when assembled for water-proofing purpose, said first connector housing having protecting members overlying at least in part said seal ring stopper slots and engaging said seal ring engaging protrusion when said connector housings are assembled for further improving water-proofing sealing, and a protecting member formed on said first connector housing and extending into said cavity for precluding removal of said seal ring from said cavity when said second connector housing is not assembled with said first connector housing.

* * * * *